US010018373B2

(12) United States Patent
Zhong et al.

(10) Patent No.: US 10,018,373 B2
(45) Date of Patent: Jul. 10, 2018

(54) SPRING FIXING STRUCTURE

(71) Applicants: Panasonic Ecology Systems Guangdong Co., Ltd., Foshan, Guangdong (CN); Panasonic Corporation, Osaka (JP)

(72) Inventors: Shenghui Zhong, Guangdong (CN); Bodong Zhong, Guangdong (CN); Naoya Araki, Aichi (JP); Masato Suzuki, Aichi (JP)

(73) Assignees: PANASONIC ECOLOGY SYSTEMS GUANGDONG CO., LTD., Foshan, Guangdong (CN); PANASONIC CORPORATION, Osaka (JP)

( * ) Notice: Subject to any disclaimer, the term of this patent is extended or adjusted under 35 U.S.C. 154(b) by 157 days.

(21) Appl. No.: 14/937,083

(22) Filed: Nov. 10, 2015

(65) Prior Publication Data

US 2016/0153680 A1 Jun. 2, 2016

(30) Foreign Application Priority Data

Nov. 28, 2014 (CN) ..... 2014 2 0735934 U

(51) Int. Cl.
*F24F 7/00* (2006.01)
*F24F 13/06* (2006.01)
*F24F 13/08* (2006.01)

(52) U.S. Cl.
CPC ..... *F24F 13/084* (2013.01)

(58) Field of Classification Search
CPC ..... F24F 13/084; F24F 13/082; F24F 2221/14
See application file for complete search history.

(56) References Cited

U.S. PATENT DOCUMENTS 2,806,726 A * 9/1957 Broberg ..... E04F 19/08 16/73
3,366,031 A * 1/1968 Hedrick ..... F24F 13/075 454/332
5,879,232 A * 3/1999 Luter, II ..... F04D 25/08 454/349
6,979,169 B2 * 12/2005 Penlesky ..... F04D 29/4226 415/1
9,022,846 B1 * 5/2015 Tom ..... F24F 7/007 454/338
9,414,142 B1 * 8/2016 Zauhar ..... H04R 1/025
9,416,989 B1 * 8/2016 Tom ..... F24F 13/078
2008/0014860 A1 * 1/2008 Heitman ..... F24F 13/078 454/310
2013/0084793 A1 * 4/2013 Yang ..... F24F 13/078 454/248

FOREIGN PATENT DOCUMENTS

JP WO 2008090724 A1 * 7/2008 ..... F24F 12/006

* cited by examiner

*Primary Examiner* — Steven B McAllister
*Assistant Examiner* — Jonathan Cotov
(74) *Attorney, Agent, or Firm* — RatnerPrestia

(57) ABSTRACT

A spring fixing structure includes a louver provided with a stopping member and a louver fixation portion thereon, and a spring disposed on the louver, the spring including a spring fixation portion fixed on the louver fixation portion and two arcuate spring legs. The stopping member is provided with a retaining mechanism for retaining the spring. The spring of the present invention can be easily mounted on the louver and prevented from being deformed.

7 Claims, 5 Drawing Sheets

SPRING FIXING STRUCTURE

CROSS-REFERENCE TO RELATED APPLICATION

This application claims the benefit of the Chinese Patent Application No. 201420735934.5 filed on Nov. 28, 2014 in the State Intellectual Property Office of China, the whole disclosure of which is incorporated herein by reference.

BACKGROUND OF THE INVENTION

Field of the Invention

The present disclosure relates to a fixing structure, and particularly, to a spring fixing structure.

Description of the Related Art

FIG. 1 is a schematic diagram showing a spring structure in the art. In order to mount a louver on a body without affecting appearance of the louver, according to the art, a splayed spring 2 is arranged on each of two opposite left and right sides of the back of the louver 3. Then, a middle portion 20 of the splayed spring 2 is connected with the louver 3, and the splayed spring 2 is placed perpendicular to the louver 3 so that the splayed spring 2 is deformed to be clamped into the body, thereby finishing mounting of the louver 3.

However, the louver 3 is not mounted on the body when it is packed and delivered. As such, in the case that the splayed spring 2 is placed perpendicular to the louver 3, two ends of the splayed spring 2 splay outwards, so that it is not convenient to receive the splayed spring 2 in the louver 3. Thus in the prior art, the connection between the splayed spring 2 and the louver 3 is a moveable connection, so that the splayed spring 2 can be laid and received in the louver 3, thereby saving a packing space.

However, the splayed spring 2 will shake during transportation because the louver 3 is not mounted on the body and the connection between the splayed spring 2 and the louver 3 is a moveable connection. As such, other components such a spiral casing, fan blades or the like may easily be hooked by the splayed spring 2 due to its shake, so that the splayed spring 2 is stretched and deformed, which adversely affects mounting of the louver 3 on the body.

SUMMARY OF THE INVENTION

An object of the present invention is to provide a spring fixing structure, which can be easily disposed on the louver and prevent the spring from being deformed.

In order to achieve the above object, the present disclosure provides a spring fixing structure, comprising a louver provided with a stopping member and a louver fixation portion thereon, and a spring disposed on the louver, the spring comprising a spring fixation portion fixed on the louver fixation portion and two arcuate spring legs, wherein the stopping member is provided with a retaining mechanism for retaining the spring.

According to an embodiment, an imaginary line is defined by linearly extending a bottom of the spring fixation portion in a direction in which the spring legs extend in a horizontal direction of the louver, and a perpendicular distance from the stopping member to the imaginary line is smaller than a perpendicular distance from the highest points of both of the two arcuate spring legs to the imaginary line when the spring is horizontally laid on the louver.

According to an embodiment, the retaining mechanism is a retaining tab provided on the stopping member.

According to an embodiment, the stopping member is in a form of a cross bar.

According to an embodiment, the corners of the retaining tab are chamfered or rounded.

According to an embodiment, the retaining tab is located at a position corresponding to the highest point of the arcuate spring leg.

According to an embodiment, the corners of the retaining tab are chamfered or rounded.

According to an embodiment, the retaining mechanism is a recess or notch provided in the stopping member, the recess or notch being located at a position corresponding to the highest point of the arcuate spring leg.

According to an embodiment, a hanging part is provided on a side of the retaining tab facing the imaginary line to protrude downwards.

The advantage of the embodiments of the present disclosure is that the spring can be easily mounted on the louver and prevented from being deformed.

DETAILED DESCRIPTION OF PREFERRED EMBODIMENTS OF THE INVENTION

Figure 1:
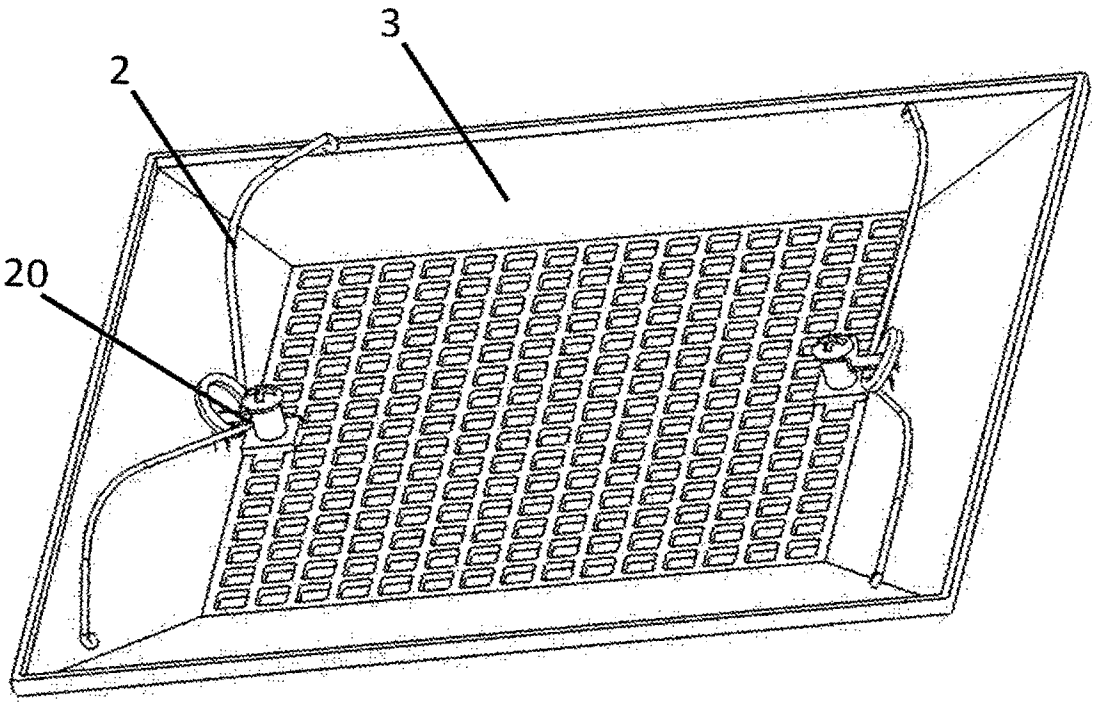
Fig. 1 Prior Art
FIG. 1 is a schematic diagram showing a spring fixing structure in the prior art.
Figure 2:
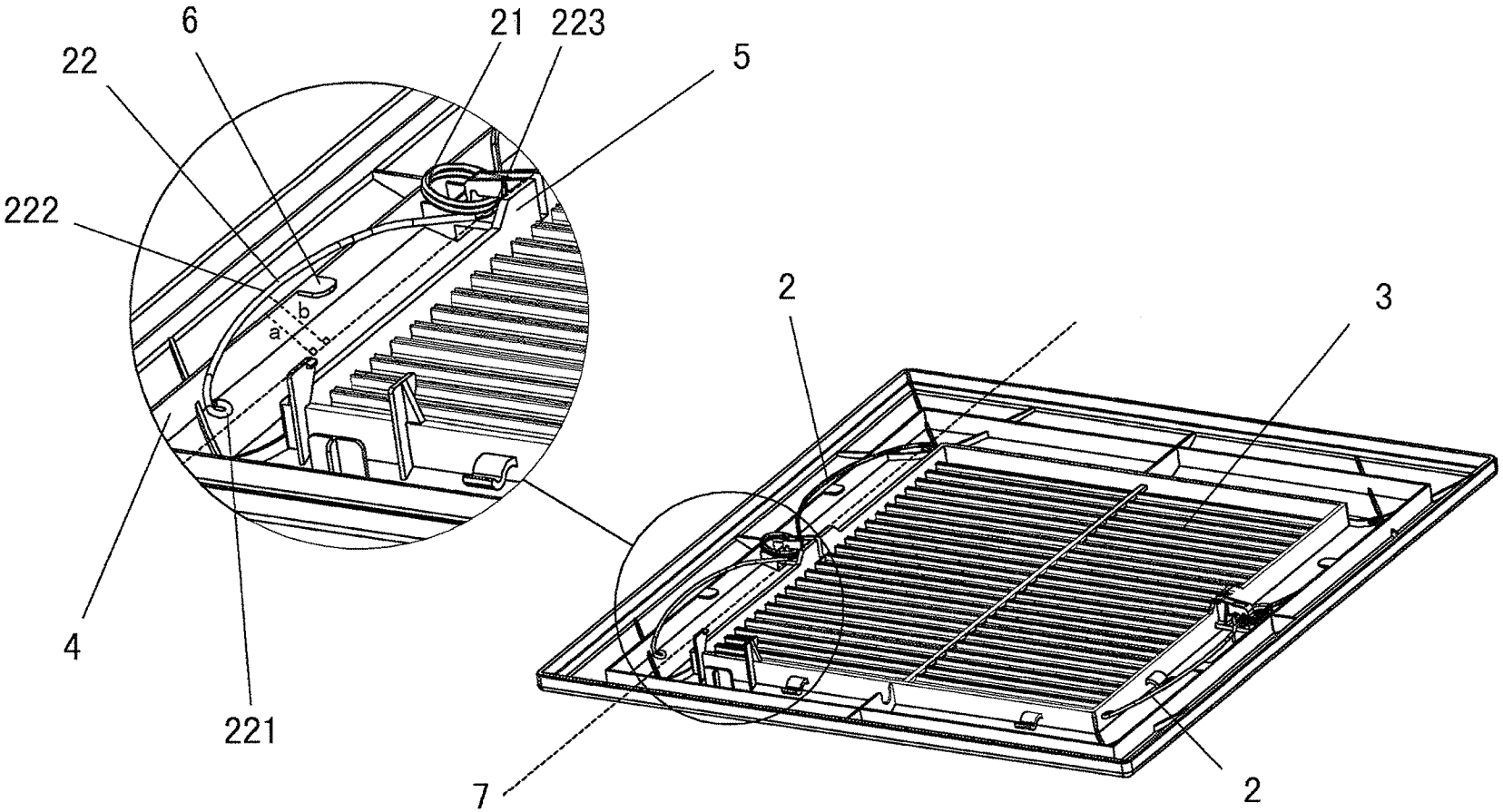
FIG. 2 is a schematic diagram of a spring before being mounted according to a first embodiment of the present disclosure.
Figure 3:
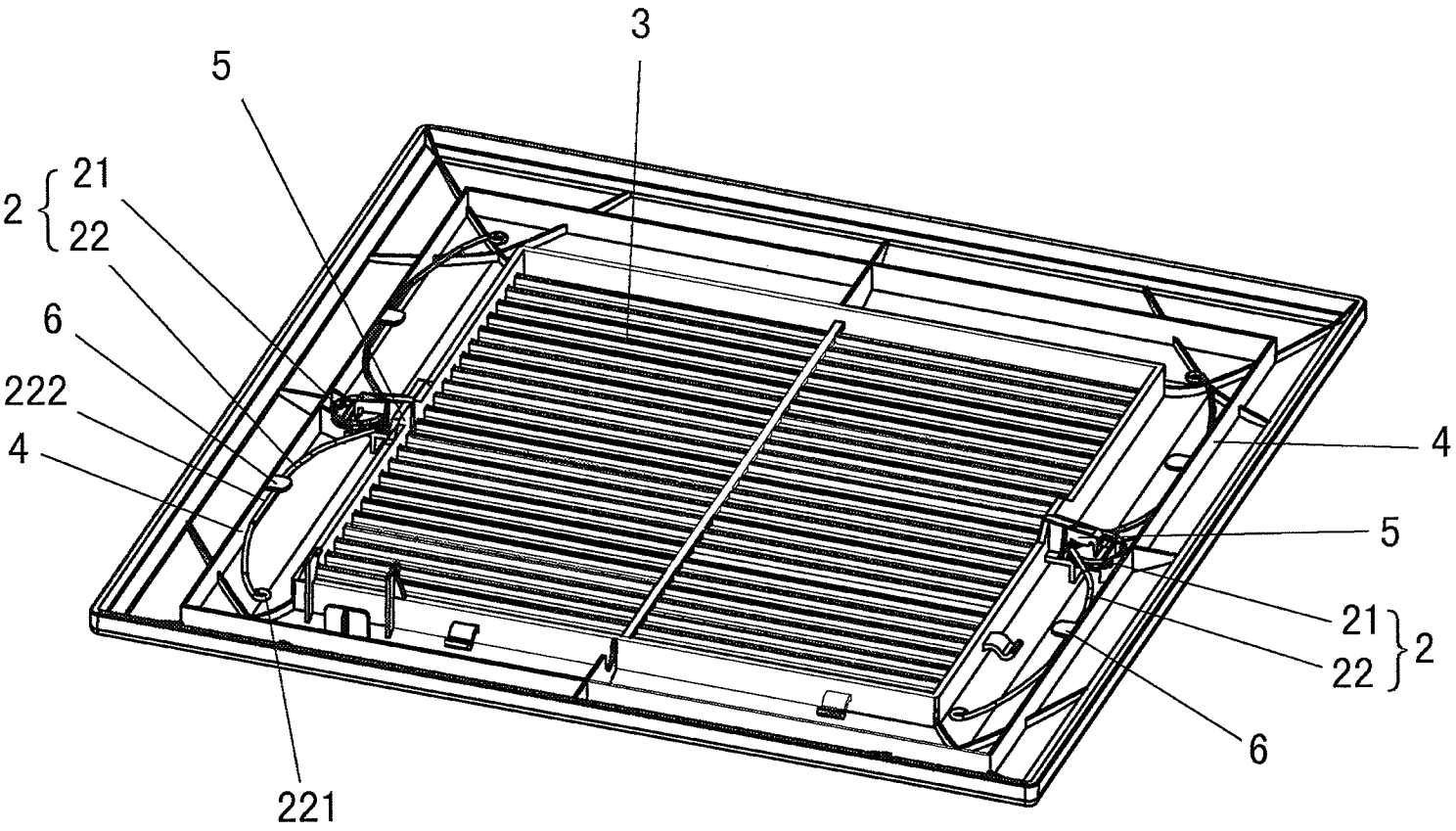
FIG. 3 is a schematic diagram of the spring after being mounted according to the first embodiment of the present disclosure.
Figure 5:
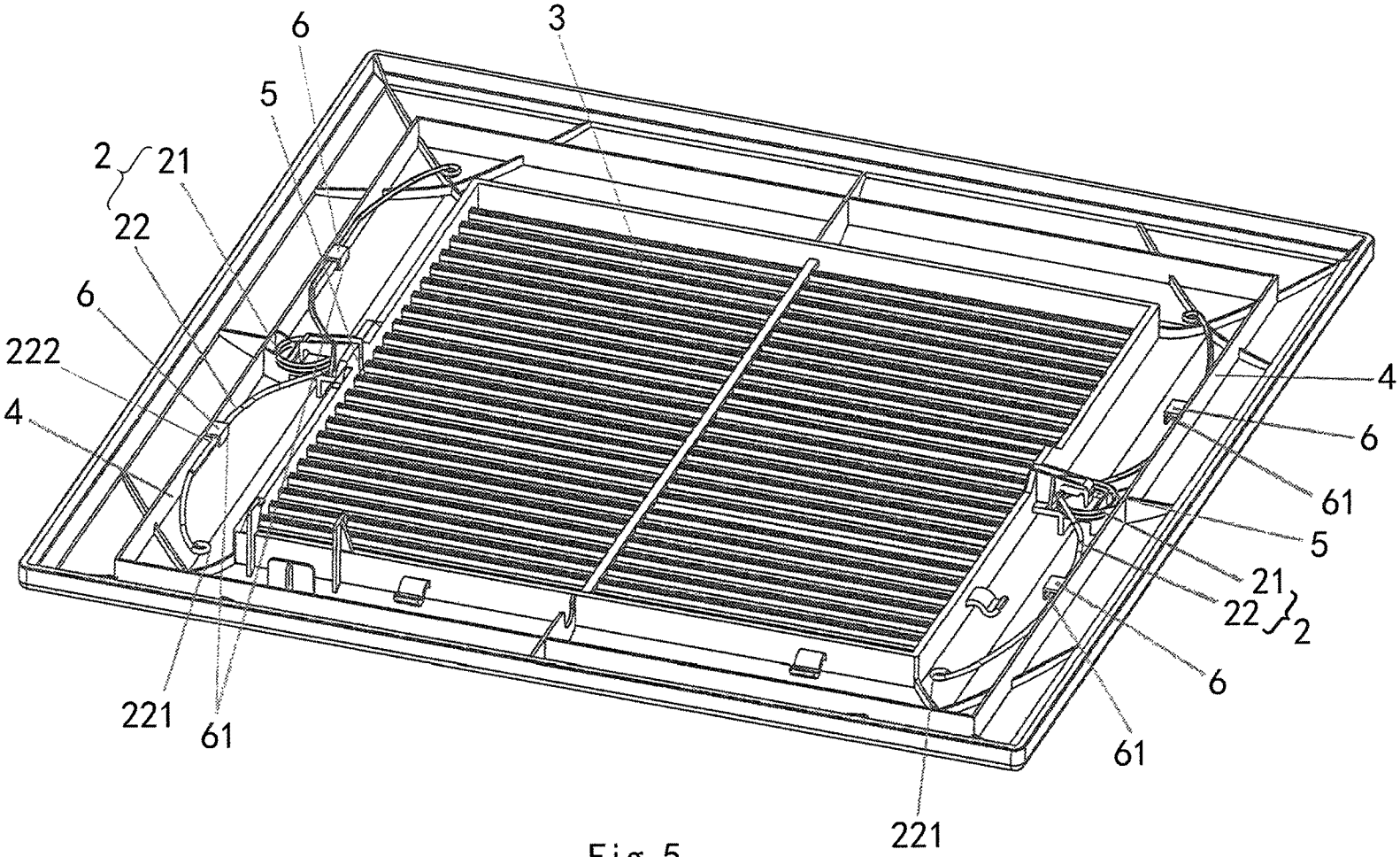
FIG. 5 is a schematic diagram showing a retaining mechanism according to a modification of the first embodiment of the present disclosure.

FIG. 2 is a schematic diagram of a spring before being mounted according to a first embodiment of the present disclosure; FIG. 3 is a schematic diagram of the spring after being mounted according to the first embodiment of the present disclosure; and FIG. 5 is a schematic diagram showing a retaining mechanism according to a modification of the first embodiment of the present disclosure.

As shown in FIG. 2 and FIG. 3, showing the first embodiment of the present disclosure, a spring fixing structure 10 comprises a louver 3, a spring 2 disposed on the louver 3, and a stopping member 4 and a louver fixation portion 5 provided on the louver 3. The spring 2 consists of a spring fixation portion 21 fixed on the louver fixation portion 5 and two arcuate spring legs 22. The stopping member 4 is a cross bar and provided with a retaining mechanism for retaining the spring 2. The retaining mechanism comprises retaining tabs 6 provided on the stopping member 4 and located at positions corresponding to the highest points 222 of the arcuate spring legs 22.

The spring fixation portion 21 near a center of the spring 2 is fixed to the louver fixation portion 5 of the louver 3; then, in order that the spring 2 can be, after being laid, fixed to the retaining mechanism, such as the retaining tabs 6, of the stopping member 4, arranged near the highest points 222 of the two spring legs 22, a force is applied to the spring legs 22 by a worker so that the spring legs 22 are deformed so as to enter the retaining mechanism. Thereafter, the force is released and the deformed spring legs 22 rebound and contact the stopping member 4 due to its resilience.

An imaginary line 7 is defined by extending the louver fixation portion 5 in a horizontal direction parallel to the spring 2. When the spring 2 is laid horizontally on the louver 3, a perpendicular distance from the stopping member 4 to the imaginary line 7 is smaller than a perpendicular distance b from the highest points 222 of both of the two arcuate spring legs 22 to the imaginary line 7.

In the present disclosure, a direction parallel to a main surface of the louver 3 is called as a horizontal direction. Further, a direction perpendicular to the main surface of the louver 3 is called as a vertical direction. Furthermore, the imaginary line 7 is a line linearly extended from the bottom 223 of the spring fixation portion 21 along an extension direction of the spring legs 22 and in the horizontal direction of the louver 3. The imaginary line 7 is opposite to the highest points 22 of the spring legs 22 and is on the side of the lowest points 221 of the spring legs 22. In addition, since the two spring legs 22 are arcuate, the two spring legs 22 have the highest points 222 and the lowest points 221 relative to the imaginary line 7.

When the spring 2 is horizontally laid on the louver 3, the perpendicular distance a from the stopping member 4 to the imaginary line 7 is smaller than the perpendicular distance b from the highest points 222 of both of the two arcuate spring legs 22 to the imaginary line 7. Firstly, a force is applied by the worker so that the spring legs 22 are horizontally deformed towards the louver fixation portion 5. When the spring legs 22 are deformed so that the perpendicular distance b from the highest point 222 to the imaginary line 7 is smaller than the perpendicular distance a from the stopping member 4 to imaginary line 7, an additional force is applied by the worker to slightly press the spring legs 22 downwards, thereby spring legs 22 can be located between the retaining tabs 6 integrated with stopping member 4 and the louver 3. Then, no force is applied by the worker to the spring legs 22, the spring 2 will rebound towards the stopping member 4 under a spring force generated due to deformation; since the stopping member 4 and the retaining tabs 6 are respectively arranged in the horizontal direction and the vertical direction in which the spring 2 moves, the spring 2 will not move further after contacting the stopping member 4 or the retaining tabs 6. Thus the spring 2 can not return to its original shape, but rather, is tightly received in a space formed by the stopping member 4 and the retaining tabs 6 and cannot come off the space.

Although the spring 2 is received in the space formed by the stopping member 4 and the retaining tabs 6 and cannot come off from the space, the spring force generated by the spring 2 is large because the spring 2 is in the deformed state. As such, the stopping member 4 is formed in a cross-bar shape, so that the strength of the stopping member 4 may be increased and the contact areas between spring legs 22 and the stopping member 4 may be increased. As a result, the spring 2 can be more firmly clamped and fixed on the stopping member 4.

In addition, as shown in FIG. 5, a hanging part 61 is provided on a side of the retaining tab 6 facing the imaginary line 7 to protrude downwards, that is, towards a space between the retaining tab 6 and the louver 3 in the vertical direction. As such, even if the spring legs 22 may be deformed to bound out from the retaining tab 6, the bounding movement will be stopped by the hanging part 61. Thus, the spring leg 22 can be better received in the space formed by the stopping member 4 and the retaining tab 6.

Further, when a length of the stopping member 4 is set to be equal to or larger than that of the spring 2, the retaining tab 6 may be provided on the stopping member 4 corresponding to any portion of the spring legs 22. However, the retaining tab 6 needs to have a sufficient length in order to limit the spring 2 from rebounding in the vertical direction after being deformed. The length of the retaining tab 6 varies depending on positions. The length means a length of the retaining tab 6 extending towards the imaginary line 7 in the horizontal direction, which length will be changed according the shape of the arcuate spring leg 22. That is, the nearer the retaining tab 6 is provided relative to the highest point 222 of the arcuate spring leg 22, the shorter the length of the retaining tab 6 may be; in contrast, the nearer the retaining tab 6 is provided relative to the lowest point 221 of the arcuate spring leg 22, the longer the length of the retaining tab 6 is.

Further, the longer the retaining tab 6 is, the smaller the strength of the retaining tab 6; moreover, the force for deforming the spring leg 22 will be larger in order to receive the spring leg 22 in the space formed by the retaining tab 6 and the louver 3. Thus, when the retaining tab 6 is provided on the stopping member 4 at a position corresponding to the highest point 222 of the arcuate spring leg 22, the length of the retaining tab 6 may be set to be shortest, a material for manufacturing the retaining tab 6 may be smallest, and the strength of the retaining tab 6 may be largest. In other words, the force for deforming the spring leg 22 may be smallest, resulting in the easiest operation for the worker.

The corners of the retaining tab 6 are all rounded or chamfered. The deformation of the spring 2 needs to be manually operated by the worker, thus it is likely that the worker may contact the retaining tab 6; when a plurality of chamfers are provided on the corners of the retaining tab 6, the chamfered retaining tab 6 is not sharp, thus the hand of the worker will not be easily scratched even if the worker contacts the retaining tab 6. In addition, the area of the retaining tab 6 is reduced compared to its original shape, which can reduce the possibility that the worker contacts the retaining tab 6, thereby greatly improving safety of operation.

Figure 4:
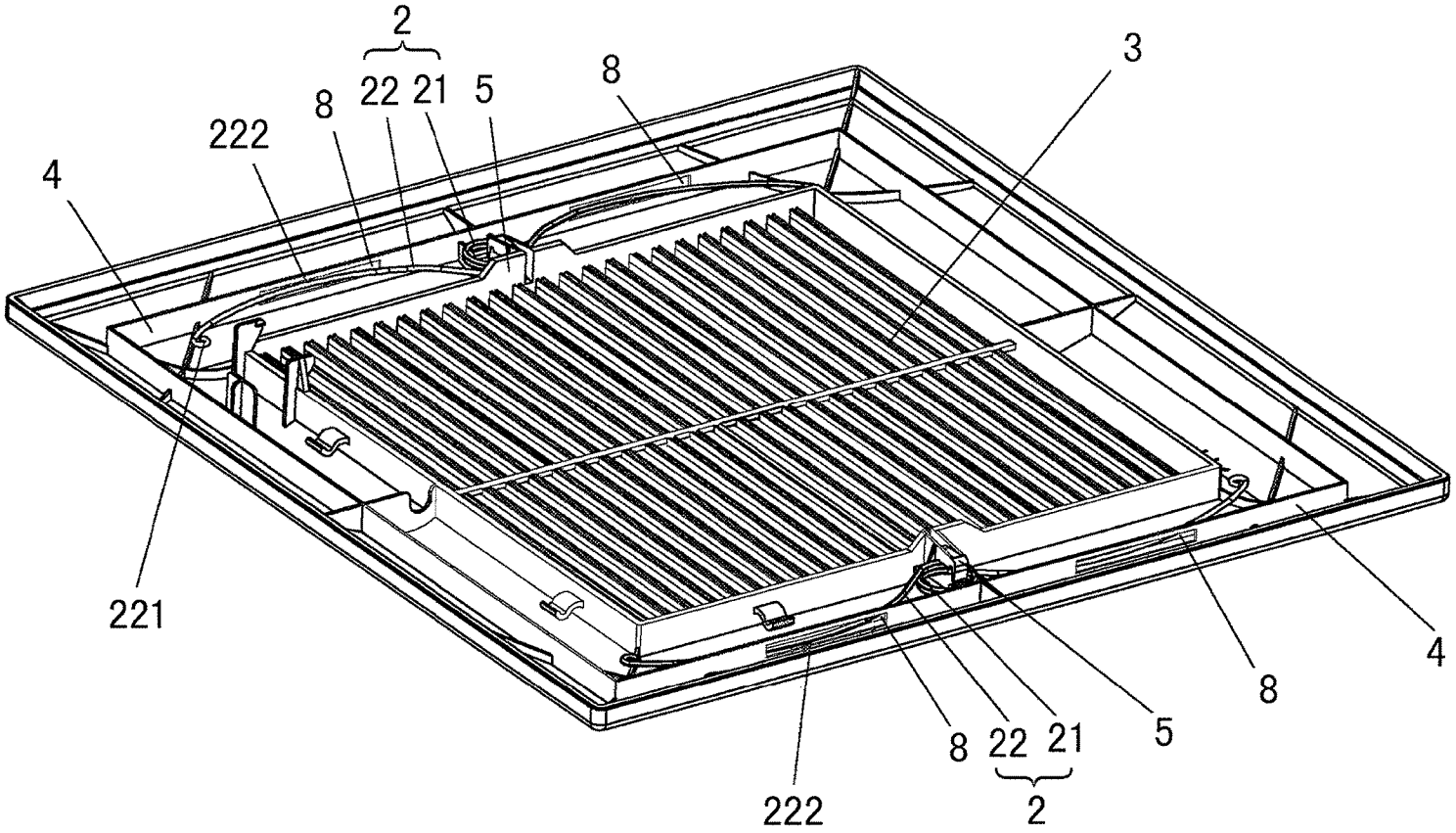
FIG. 4 is a schematic diagram of a stopping member according to a second embodiment of the present disclosure.

FIG. 4 is a schematic diagram of a stopping member according to a second embodiment of the present disclosure.

The difference between the second embodiment and the first embodiment is only in that the retaining mechanism of the first embodiment comprises the retaining tabs 6 (see FIG. 2), while the retaining mechanism of the second embodiment comprises recesses or notches 8 formed in the stopping member 4, and the recesses or notches 8 are located at positions corresponding to the highest points 222 of the arcuate spring legs 22.

Also, during mounting, a force is applied by the worker to horizontally deform the spring legs 22 towards the louver fixation portion 5. The spring legs 22 are deformed so that the perpendicular distance b from the highest point 222 to the imaginary line 7 is smaller than the perpendicular distance a from the stopping member 4 to imaginary line 7. Then, no force is applied by the worker to the spring legs 22, the spring 2 will generate a resilient force due to deformation so that the spring 2 rebounds towards the stopping member 4. At this time, since the recesses or notches 8 are provided in the stopping member 4 at the positions corresponding to the highest points 222 of the arcuate spring leg 22, the highest points 222 of the spring leg 22 will contact the recesses or notches 8, then the spring 2 is clamped into the recesses or notches 8 under the resilient force. Therefore, the spring 2 can be simply disposed on the louver 3 and prevented from being deformed.

What is claimed is:

1. A spring fixing structure, comprising a louver provided with a stopping member and a louver fixation portion, and a spring disposed on the louver, the spring comprising a spring fixation portion fixed on the louver fixation portion and two arcuate spring legs, wherein the stopping member is provided with a retaining mechanism for retaining the spring legs of the spring, wherein an imaginary line is defined by linearly extending a bottom of the spring fixation portion in a direction in which the spring legs extend in a horizontal direction of the louver, and the spring legs each have a highest point defined as having a longest perpendicular distance from the imaginary line when the spring is horizontally laid to be parallel with the louver and is not restrained by the stopping member; and wherein a perpendicular distance from the stopping member to the imaginary line is smaller than a perpendicular distance from the highest points of the spring legs to the imaginary line when the spring is horizontally laid on the louver, wherein the retaining mechanism is provided on the stopping member, and the retaining mechanism is one of a notch, a recess, and a retaining tab, and the retaining mechanism holds the spring in a deformed state.

2. The spring fixing structure according to claim 1, wherein the stopping member is in a form of a cross bar.

3. The spring fixing structure according to claim 1, wherein the corners of the retaining tab are chamfered or rounded.

4. The spring fixing structure according to claim 1, wherein the retaining tab is located at a position corresponding to the highest point of the arcuate spring leg.

5. The spring fixing structure according to claim 4, wherein the corners of the retaining tab are chamfered or rounded.

6. The spring fixing structure according to claim 1, the recess or notch being located at a position corresponding to the highest point of the arcuate spring leg.

7. The spring fixing structure according to claim 1, wherein a hanging part is provided on a side of the retaining tab facing the imaginary line to protrude downwards.

* * * * *